US006256920B1

(12) United States Patent
Olson

(10) Patent No.: US 6,256,920 B1
(45) Date of Patent: Jul. 10, 2001

(54) SAFETY SECURING DEVICES FOR SMALL ARMS

(75) Inventor: Douglas D. Olson, Vero Beach, FL (US)

(73) Assignee: Knight's Armament Company, Vero Beach, FL (US)

( * ) Notice: Subject to any disclaimer, the term of this patent is extended or adjusted under 35 U.S.C. 154(b) by 0 days.

(21) Appl. No.: 09/408,208

(22) Filed: Sep. 29, 1999

(51) Int. Cl.[7] ..... F41A 17/02
(52) U.S. Cl. ..... 42/70.11; 42/70.02
(58) Field of Search ..... 42/70.02, 70.07, 42/70.11

(56) References Cited

U.S. PATENT DOCUMENTS 3,018,576 * 1/1962 Riechers ..... 42/70.02
3,877,267 * 4/1975 Harris, Jr. ..... 70/358
4,532,729 * 8/1985 Von Muller ..... 42/70.02
4,709,496 * 12/1987 Johnson ..... 42/70.11
5,491,992 * 2/1996 Mandall ..... 70/232
5,918,402 * 7/1999 Weinraub ..... 42/70.07
5,988,376 * 11/1999 Lax ..... 70/276
6,052,934 * 4/2000 Carpenter ..... 42/70.11

FOREIGN PATENT DOCUMENTS

2920679 * 11/1979 (DE) ..... 42/70.11
4009372 * 10/1990 (DE) ..... 42/70.11

* cited by examiner

*Primary Examiner*—Stephen M. Johnson
(74) *Attorney, Agent, or Firm*—Carroll F. Palmer

(57) ABSTRACT

A firearm safety device for a magazine type firearm structured for insertion into the cavity opened in said firearm when the magazine of said firearm is removed has a lock base, a locking bar and a pair of locking rods. The lock base is formed of a first half and a second half fastened together defining therebetween a quadrilateral space and the locking bar is moveably retained in that quadrilateral space with its proximal end extending outside the lock base to enable it to be reciprocated relative to the lock base and the locking rods are moveably retained in the lock base to be moved by the distal end of the locking bar between a latching position to lock the safety device in the firearm cavity and an unlatching position to allow the safety device to be removed from such cavity.

10 Claims, 6 Drawing Sheets

14
28
26
34

14
24
30
18
32
40
26
22

12
98

14
24
36
38
42
44
26
40

14
XIII
28
30
32
20
42
44
34
22
XIII

SAFETY SECURING DEVICES FOR SMALL ARMS

BACKGROUND OF THE INVENTION

1. Field of the Invention

This application relates to safety securing devices for small arms. More particularly, it concerns firearm safety devices that can be inserted into a wide variety of small weapons to render them safe from inadvertent use, but can be easily removed by authorized persons to render them quickly operable.

2. Description of the Prior Art

There are a number of firearm trigger lock devices that attempt to render the weapon safe by locking only the position of the trigger, e.g., see U.S. Pat. Nos. 5,560,134, 5,433,028, 5,417,000, 5,146,705, 3,964,383, 2,741,726 and 2,512,140. The utility of such locks is limited since, for example, they do not prevent the removal of the upper receiver assembly from an AR15/M16 type weapon which could still be fired by striking the firing pin with a pin and hammer.

In contrast, the new safety securing devices for small arms of the invention provide more extensive protection against unauthorized use since they require the bolt to be locked to the rear position to allow their insertion into the weapon.

A variety of firearm locks that do not focus on trigger position and involve insertion of locking elements on or into portions of the firearm intended to be rendered safe are known, e.g., see U.S. Pat. Nos. 2,742,727, 4,532,729, 4,654,992, 4,987,693, 5,419,069, 5,446,986, 5,611,164, 5,680,723 and 5,737,864.

The present invention provides further improvements in removable firearm safety devices that render them remarkable as compared with any of prior known firearm lock devices, including those referenced above, as will become apparent from the following disclosures.

OBJECTS

A principal object of the invention is the provision of a remarkable new type of removable firearm safety devices.

Further objects include the provision of removable firearm safety devices that:

1. Assure that the firearm's magazine is removed from the weapon.

2. Guarantee that the firearm's bolt is withdrawn from the locking recess to assure that the firing pin cannot reach a primer.

3. Prevent disassembly of the firearm to allow firing in some fashion without removing the new firearm safety device.

4. Make movements of the trigger totally ineffective in attempting to fire the weapon.

5. Effectively tie "all parts of the gun together" in performing the locking operation.

6. Will work on automatic pistols, but not on revolvers and will be dimensionally weapons specific.

7. Function by the expansion of "dogs" (locking bars) into a transverse width that is larger than the entry size of the weapon cavity into which the removable firearm safety device is inserted in the locking operation.

Additional objects include the provision of a new type of firearm safety devices that offer the following advantages:

A. No metal parts to mar the finish of the firearm by using all plastic construction.

B. Allows user to lock the device in place with any hasp or padlock he already has (as long as it physically fits through the locking hole in the new firearm safety device) and can even be secured with cable ties which are used to secure weapons at many gun shows.

C. Provides a level of safety above that offered by mere trigger locks.

D. Enables pulling the locking bar away from the bottom of the firearm lock to lift the weapon's magazine latch thus allowing the lock to continue being removed from the weapon. Such one motion removal is desirable for reducing the time required to get the weapon into action if required.

E. Permits the magazine lock to hold the firearm lock in the weapon through out storage time whereby the locking bars of the firearm safety device do not wear against the dry film lubrication in the weapon's upper receiver and also keeps the weapon's magazine lock spring from being subjected to long term storage in a compressed position.

F. Enables the degree of the locking to be independent of the diameter of the weapon's lock shank. The new safety devices require a full 0.375 inches of stroke before their locking bars start to retract which means even a small diameter cable can be threaded through the large lock hole and still be securely held within the weapon.

G. Accept a locking bar within a gun rack that holds multiple similar weapons making use of the new firearm locks easier than having many single padlocks.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of safety devices that, when inserted into a firearm, renders it safe from inadvertent use. As with all such devices, the new devices of this invention can be removed from the weapon by destroying the safety device per se or cutting off the lock that interfaces with such device, but they are intended to make the weapons in which they are installed reasonably inaccessible to children and adults.

The new firearm locks require the bolt of the secured weapon to be locked to the rear position to allow insertion. Thus, they enter the weapon through the magazine cavity and pushing the locking bar of the new firearm locks closed expands two locking rods that expand into a cavity within the upper receiver of the weapon. Since the upper receiver cavity is larger than the passageway of the magazine, the firearm lock can not be pulled back thorough the passageway. The firearm safety device has a lower shoulder that is larger than the magazine cavity within the weapons lower receiver that prevents removal of the firearm safety device by pulling it upward and through the lower receiver.

The new firearm safety devices also have a shoulder that prevents the magazine release from releasing the bolt and carrier to travel forward.

Advantageously, the new firearm safety devices are molded from orange plastic to make them visible from a distance. That is important for use in gun ranges and at gun shows where it is necessary to be able to rapidly identify that a weapon is in a safe state. Alternatively, they may be made in other colors and a variety of moldable materials.

A particular advantage of the new firearm safety devices is that they can work with any type of locking device (padlock) that the gun owner already has thereby allowing him to have matched locks for all his weapons.

The new removable firearm safety devices work with AR15/M16 style weapons, but can be used in designs of other similar devices to lock firearms which have some type of internal cavity into which the locking bars can expand, e.g., insertion into bolt action type firearms from the top. The bolt is withdrawn to the rear position and the new firearm safety devices are inserted through the cartridge feed lips and expand into the space below them. On pump fed and auto loading shotguns, the new firearm safety devices can be inserted through the ejection port and expanded to the larger cavity within the weapon. On auto-loading pistols, the new firearm safety devices can be inserted through the magazine cavity and extend through the ejection port in the slide. The expansion bars of the new firearm safety devices can expand into the recesses within the frame of the gun under the grips. Thus, there are many different types of firearms to which the removable safety devices of the invention can be adapted.

BRIEF DESCRIPTION OF THE DRAWINGS

A more complete understanding of the invention can be obtained by reference to the accompanying drawings in which generic parts of the illustrated matter are indicated by arrowhead lines associated with the designation numerals while specific parts are indicated with plain lines associated with the numerals and wherein.

DESCRIPTION OF THE PREFERRED EMBODIMENTS

Figure 1:
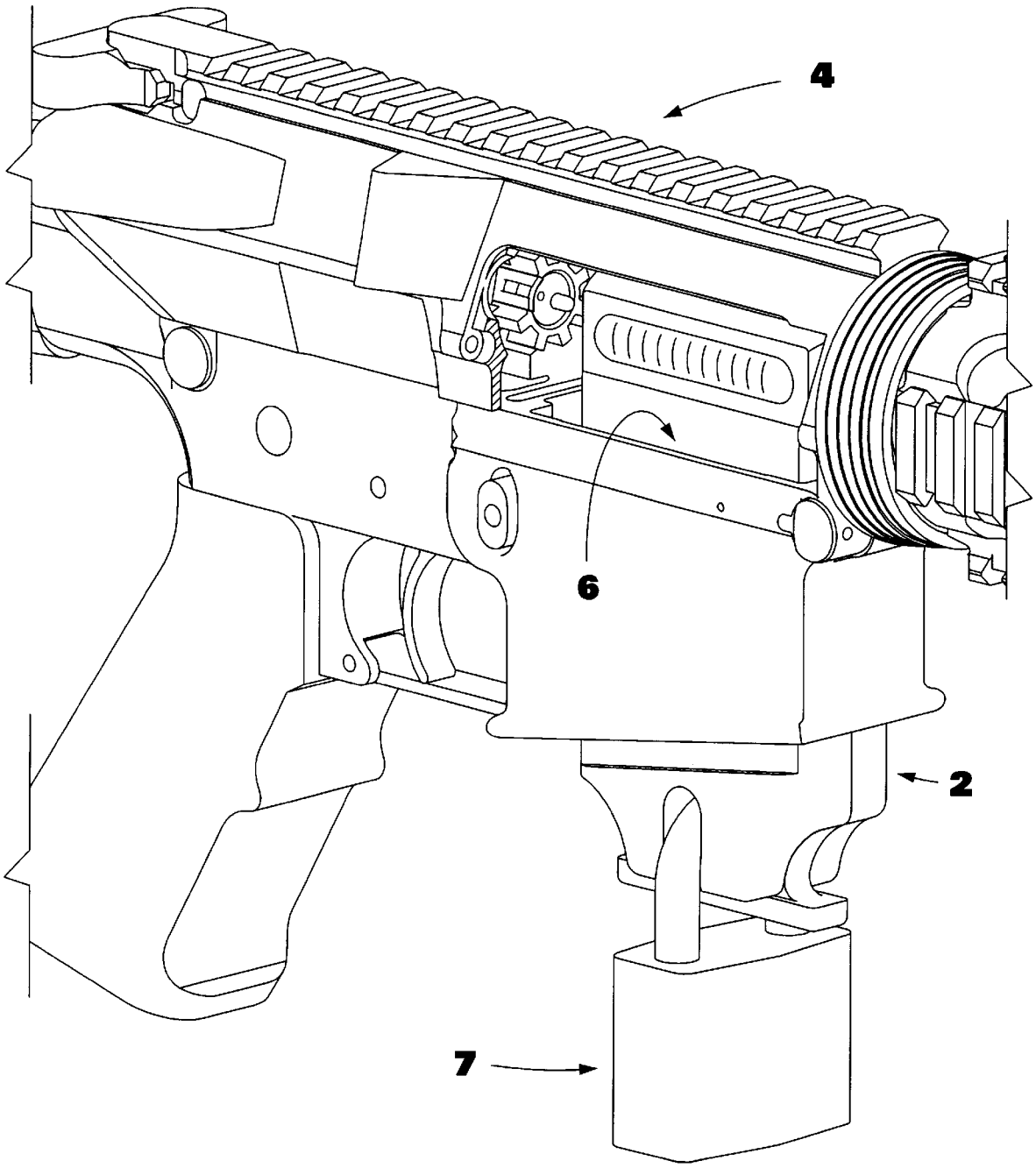
FIG. 1 is a partially broken away, schematic, isometric view of an AR15/M16style weapon with a firearm safety device of the invention operatively positioned therein.
Figure 2:
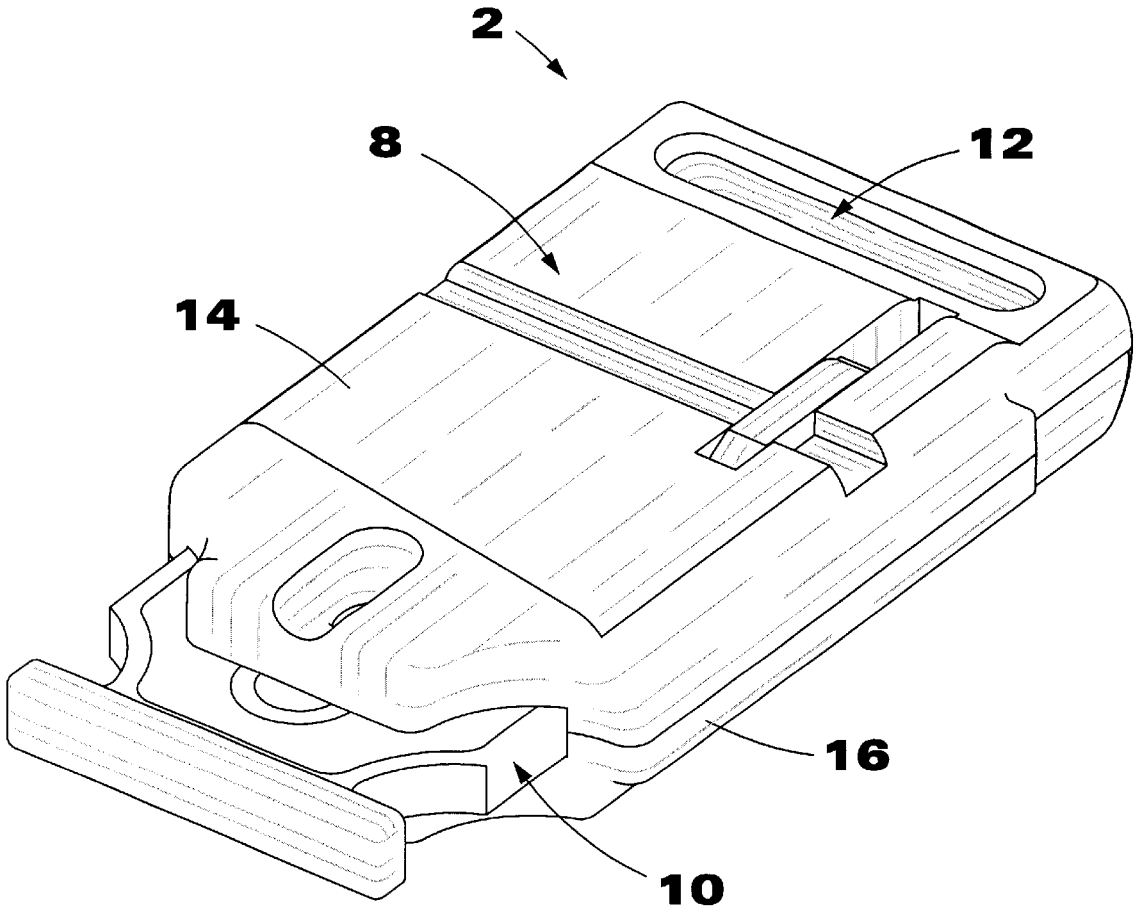
FIG. 2 is an isometric view of a specific embodiment of a firearm safety device of the invention in its unlocked condition ready for insertion into a firearm to render it safe.
Figure 3:
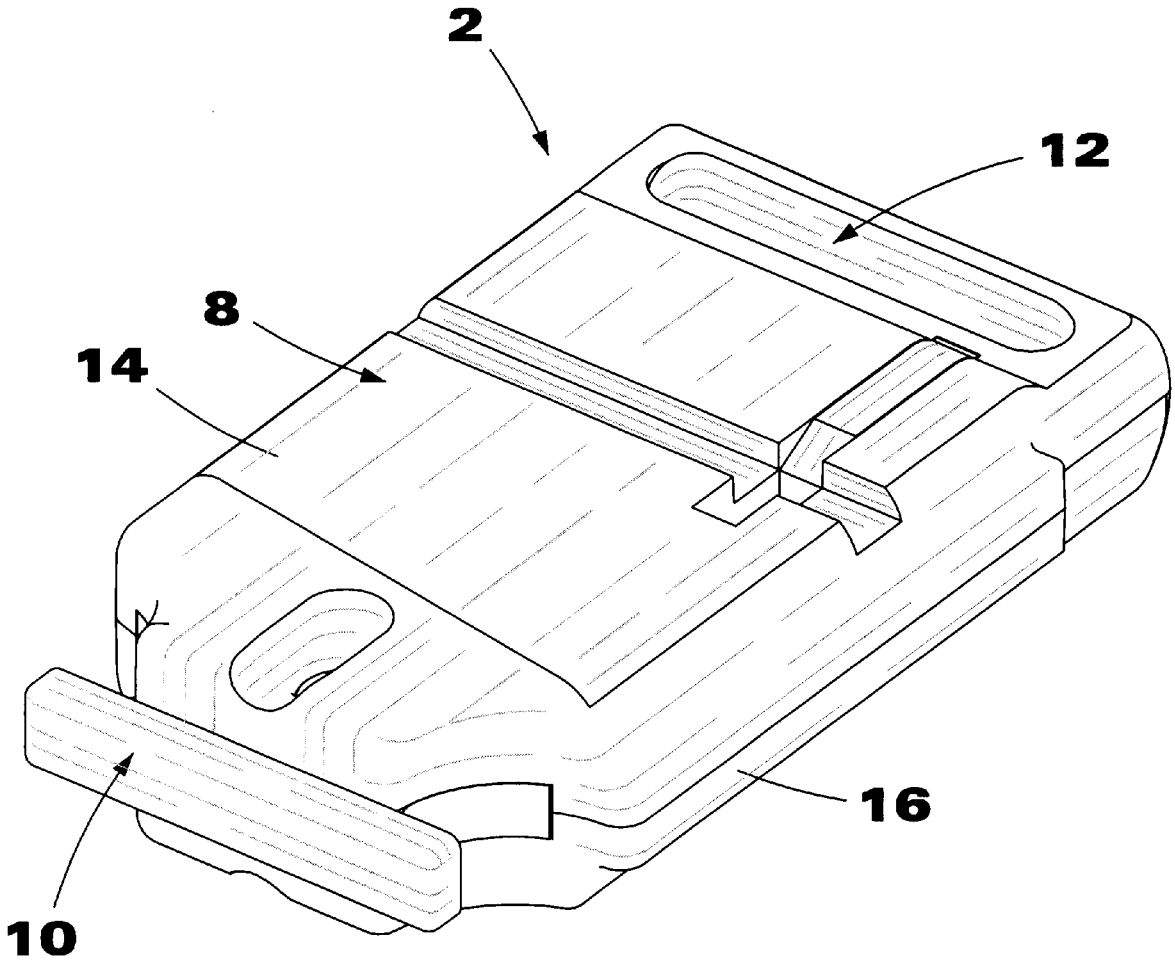
FIG. 3 is an isometric view of the firearm safety device of FIG. 2 showing its condition after insertion into a firearm and latched into the firearm.
Figure 7:
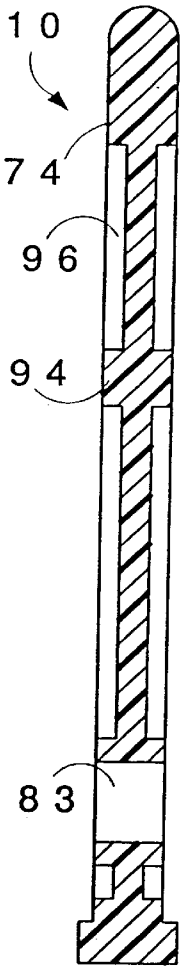
FIG. 7 is a sectional view of the locking bar taken on the line VII—VII of FIG. 4.
Figure 6:
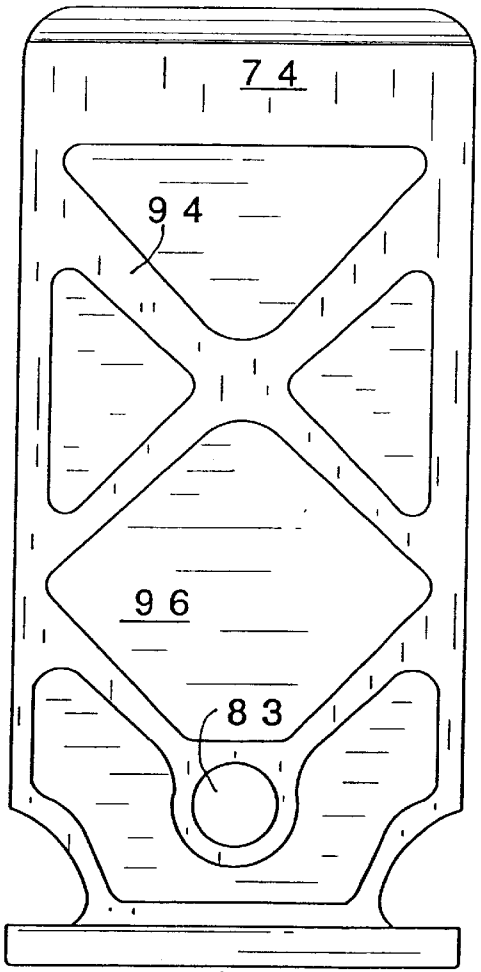
FIG. 6 is a reverse view of the locking bar.
Figure 5:
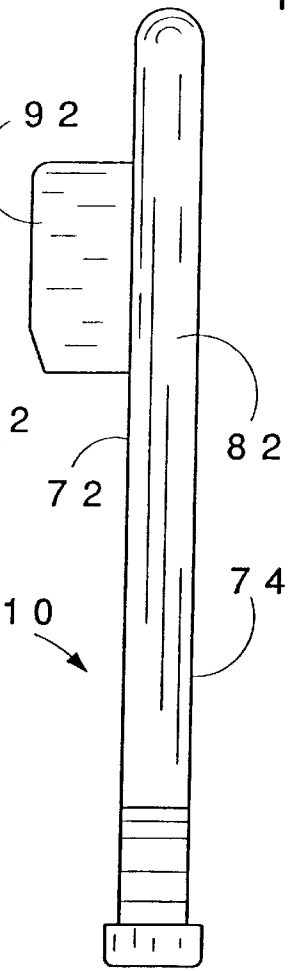
FIG. 5 is a lateral view of the locking bar.
Figure 4:
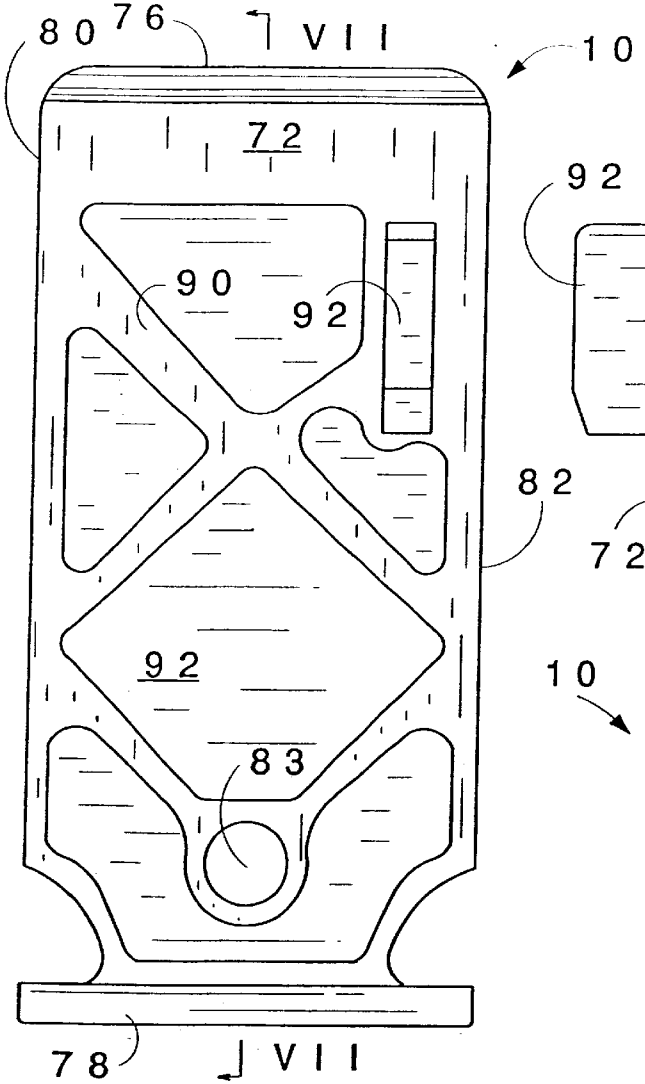
FIG. 4 is an obverse view of locking bar of the firearm safety device shown in FIG. 2.
Figures 8, 9, 10, 11:
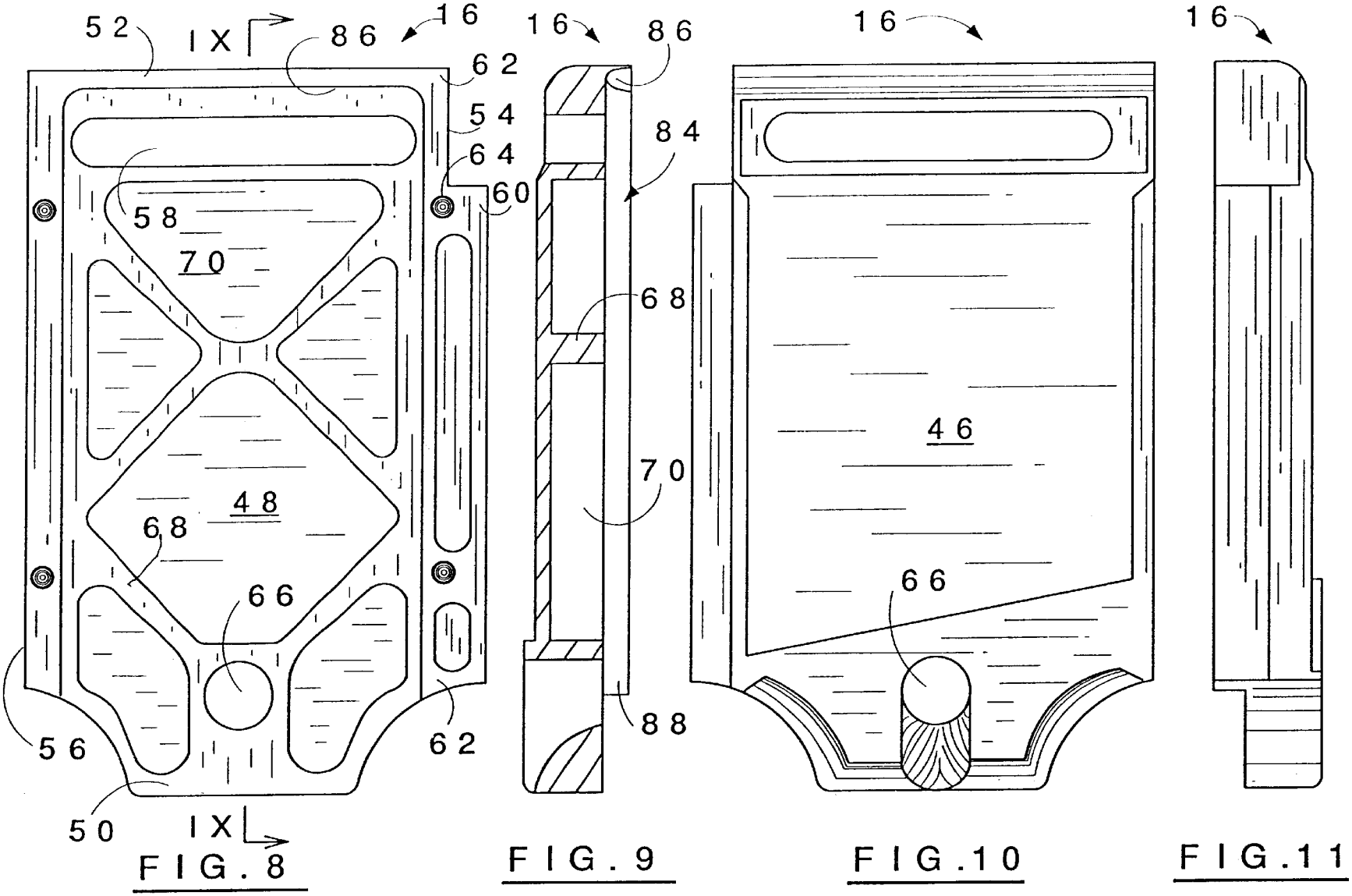
FIG. 8 is an reverse view of the one half of the lock base of the firearm safety device shown in FIG. 2.
FIG. 9 is a sectional view of this half of the lock base taken on the line IX—IX of FIG. 8.
FIG. 10 is a obverse view of this half of the lock base.
FIG. 11 is a lateral view of this half of the lock base.
Figures 12, 13, 14, 15, 16:
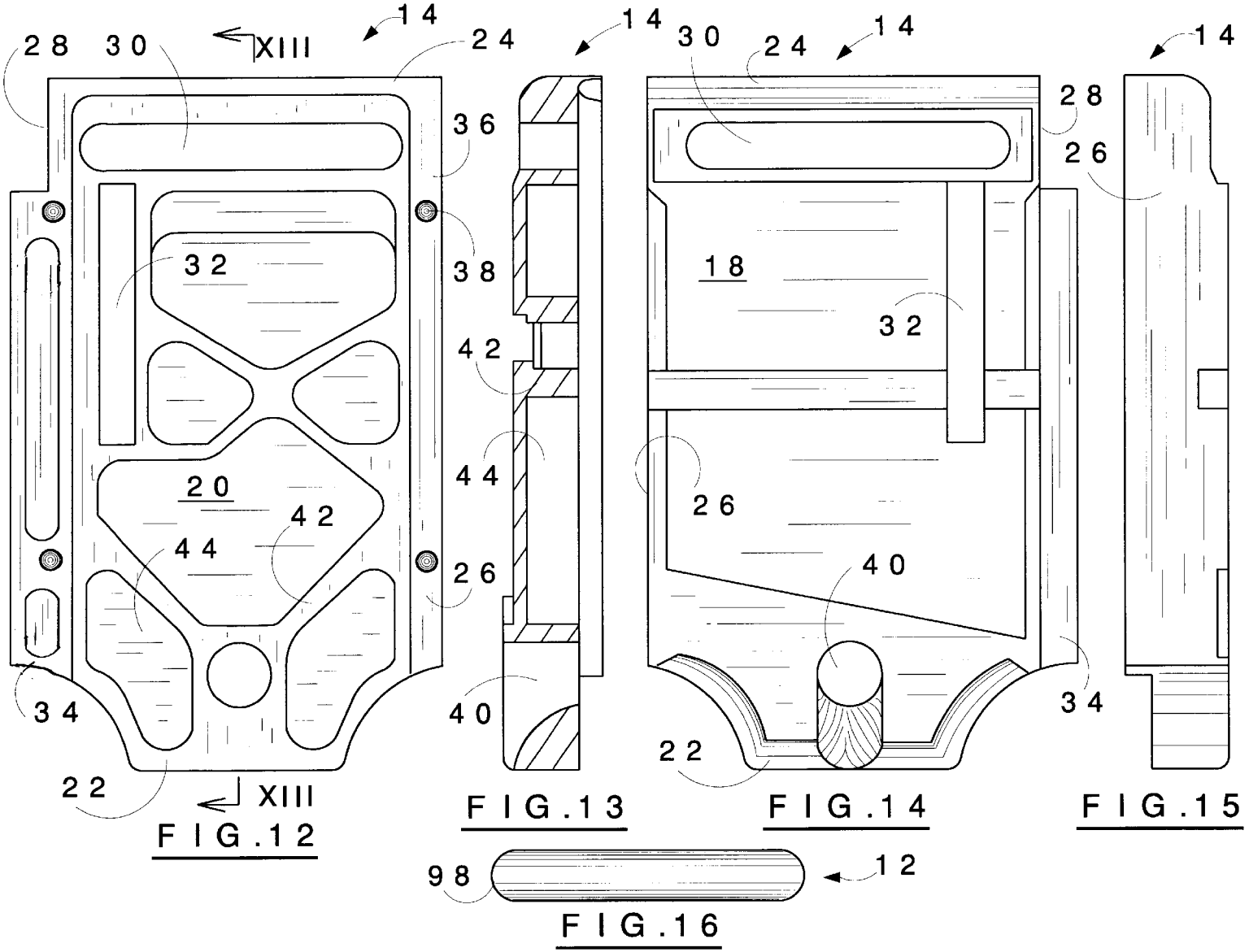
FIG. 12 is an reverse view of the other half of the lock base of the firearm safety device shown in FIG. 2.
FIG. 13 is a sectional view of the taken on the line XIII—XIII of FIG. 12.
FIG. 14 is a obverse view of the other half of the lock base.
FIG. 15 is a lateral view of the other half of the lock base.
FIG. 16 is a plan view of the locking rod of the firearm safety device shown in FIG. 2.

With reference to FIGS. 1–3 of the drawings, a firearm safety device 2 of the invention for a magazine type firearm 4 is structured for insertion into the cavity 6 opened in the firearm 4 when its magazine (not shown) is removed and for latching in cavity 6. A padlock 7 is used to lock the safety device in the firearm 4.

The drawings are related to an embodiment of the new safety devices 2 specifically adapted for use with an AR15/M16 style weapon. The exact configuration of other embodiments will vary in order to address specific constructions of the cavity 6 and other related parts of different firearms will demand while incoporation the essential parts of new safety devices as further described below.

The essential parts of device 2 are a lock base 8, a locking bar 10 and a pair of locking rods 12. The lock base comprises a first half 14 and a second half 16.

With reference to FIGS. 12–15, the first half 14 is defined by a first obverse 18, a first reverse 20, a first insertion end 22, a first opposite end 24 and a pair of first parallel sides 26 and 28 extending between the ends 22 & 24 respectively.

There is an elongated opening 30 in the end 24 and an elongated slot 32 extends parallel to side 28 though obverse 18 and reverse 20.

A ledge 34 extends from side 28 and forms part of the closure surface 36 that extends from side 26 around end 24 to side 28. The closure surface 36 includes bores 38 to receive fasteners (not shown) to fix halves 14 & 16 together. In other embodiments of the invention (not shown) where halves 14 & 16 would be fixed together by ultrasonic welding, the bores 38 would be omitted.

Finally, half 14 has through bore 40 that can receive the shank of padlock 7 and a plurality of trusses 42 plus plastic saving cavities 44.

With reference FIGS. 8–11, second half 16 is defined by a second obverse 46, a second reverse 48, a second insertion end 50, a second opposite end 52 and a pair of second parallel sides 54 & 56 extending between the ends 50 & 52 respectively.

There is an elongated opening 58 in the end 52 and a ledge 60 extends from side 54 and forms part of the closure surface 62 that extends from side 54 around end 52 to side 56. The ledge 60 includes bores 64 to receive fasteners (not shown) to fix halves 14 & 16 together. In other embodiments of the invention (not shown) where halves 14 & 16 would be fixed together by ultrasonic welding, the bores 64 would be omitted.

Finally, half 14 has through bore 66 that can receive the shank of padlock 7 and a plurality of trusses 68 plus plastic saving cavities 70.

With reference FIGS. 4–7, the locking bar 10 with a first surface 72 and a second surface 74 has a generally quadrilateral periphery defined by a first distal end 76, a first proximal end 78, a pair of third parallel sides 80 & 82 and a bore 83.

The first half 14 and the second half 16 are fastened together with the first reverse 20 facing the second reverse 48 defining therebetween a quadrilateral space 84 defined by a second distal end 86 and a proximal opening 88 within which the locking bar 10 is moveably retained with the first proximal end 78 extending outside the lock base 8 through the first and second insertion ends 22 & 50 to enable the locking bar 10 to be reciprocated relative to the lock base 8.

Face 72 of locking bar 10 has a plurality of trusses 90 plus plastic saving cavities 92 and face 74 has a plurality of trusses 94 plus plastic saving cavities 96.

The locking rods 12, which preferably have a cylindrical shape with rounded ends 98, are captured in the lock base 8 between the first and second elongated openings 30 & 58, with the elongated openings and locking rods being longitudinally aligned.

The locking rods 12 are moveable relative to the elongated openings by the first distal end 24 of the locking bar between a locking position (see FIG. 3) and an unlocking position (see FIG. 2), but are slightly larger in diameter than the width of openings 30 & 58 so that they can not come out of the lock base 8.

Finally, the locking bar 10 comprises a lateral lug 92 that extends into the elongated slot 32 in first half 14 of lock base 8 to limit the movement of the locking bar 10 in the direction of its unlatching position (see FIG. 2). In the specific embodiment 2 of the new safety devices 2, the lug 92 also lifts the magazine latch (not numbered) as it moves to the unlatched position shown in FIG. 2 allowing removal of device 2 without need to depress the magazine release (not numbered).

What is claimed is:

1. A firearm safety device for a firearm structured for insertion into the cavity opened in said firearm when said firearm is disarmed and for latching in said cavity comprising:

a lock base, a locking bar, and a pair of locking rods, said lock base comprising a first half and a second half fastened together defining therebetween a quadrilateral space, said locking bar having a generally quadrilateral periphery defined by a distal end, a proximal end and a pair of parallel sides extending between said distal end and said proximal end, said locking bar being moveably retained in said quadrilateral space with said proximal end extending outside said lock base to enable said locking bar to be reciprocated relative to said lock base, and said locking rods being moveably retained in said lock base to be moved by said distal end of said locking bar between a latching position and an unlatching position.

2. The firearm safety device of claim 1 wherein said lock base is rectangular in shape.

3. The firearm safety device of claim 2 wherein said locking bar is generally rectangular in shape defined by a major axis and a minor axis.

4. The firearm safety device of claim 3 wherein said locking rods are cylindrical.

5. The firearm safety device of claim 4 wherein said lock base comprises an elongated slot in said first half and said locking bar comprises a lateral lug that extends into said elongated slot to limit the movement of said locking bar in the direction of said unlatching position.

6. A firearm safety device for a removable magazine firearm structured for insertion into the cavity opened in said firearm when the magazine of said firearm is removed and for latching in said cavity comprising:

a lock base, a locking bar, and a pair of locking rods, said lock base being generally quadrilateral in shape and comprising a first half defined by a first obverse, a first reverse, a first insertion end, a first opposite end and a pair of first parallel sides extending between said first insertion end and said first opposite end plus a second half defined by a second obverse, a second reverse, a second insertion end, a second opposite end and a pair of second parallel sides extending between said second insertion end and said second opposite end, said locking bar comprising a first surface and a second surface and having a generally quadrilateral periphery defined by a first distal end, a first proximal end and a pair of third parallel sides extending between said distal end and said proximal end, said first half and said second half being fastened together with said first reverse facing said second reverse defining therebetween a quadrilateral space defined by a second distal end and an open end within which said locking bar is moveably retained with said first proximal end extending outside said lock base through said first and second insertion ends to enable said locking bar to be reciprocated relative to said lock base, a first elongated opening in said first opposite end and second elongated opening in said second opposite end of said first and second halves of said lock base, said elongated openings being longitudinally aligned, said locking bar being captured in said lock base between said first and second elongated openings with said elongated openings and locking rod being longitudinally aligned, and said locking rods being moveable relative to said elongated openings by said first distal end of said locking bar between a locking position and an unlocking position.

7. The firearm safety device of claim 6 wherein said lock base is generally rectangular in shape.

8. The firearm safety device of claim 7 wherein said locking bar is generally rectangular in shape.

9. The firearm safety device of claim 8 wherein said locking rods are cylindrical.

10. The firearm safety device of claim 9 wherein said lock base comprises an elongated slot in said first half and said locking rod comprises a lateral lug that extends into said elongated slot to limit the movement of said locking bar in the direction of said unlatching position.

* * * * *